US010813461B2

(12) United States Patent
Lessard

(10) Patent No.: US 10,813,461 B2
(45) Date of Patent: Oct. 27, 2020

(54) METHOD FOR FABRICATING ANATOMICAL CUSHION AND DEVICE TO CAPTURE PRESSURE CONTROLLED SHAPE

(71) Applicant: Equipements Sportifs Keku Inc., Sherbrooke, Quebec (CA)

(72) Inventor: Jean-Luc Lessard, Sherbrooke (CA)

(73) Assignee: Equipements Sportifs Keku Inc., Sherbrooke, Quebec (CA)

( * ) Notice: Subject to any disclaimer, the term of this patent is extended or adjusted under 35 U.S.C. 154(b) by 719 days.

(21) Appl. No.: 15/588,401

(22) Filed: May 5, 2017

(65) Prior Publication Data

US 2017/0318968 A1 Nov. 9, 2017

Related U.S. Application Data

(60) Provisional application No. 62/332,519, filed on May 6, 2016.

(51) Int. Cl.

| | |
|---|---|
| ***A47C 27/10*** | (2006.01) |
| ***A47C 7/02*** | (2006.01) |
| ***A47C 27/08*** | (2006.01) |
| ***A47C 31/12*** | (2006.01) |
| ***A61G 7/057*** | (2006.01) |
| ***A61G 5/10*** | (2006.01) |
| ***A47C 7/35*** | (2006.01) |
| ***B68G 1/00*** | (2006.01) |
| ***B68G 7/05*** | (2006.01) |

(52) U.S. Cl.
CPC ..... *A47C 7/029* (2018.08); *A47C 7/35* (2013.01); *A47C 27/082* (2013.01); *A47C 27/083* (2013.01); *A47C 27/085* (2013.01); *A47C 27/086* (2013.01); *A47C 31/126* (2013.01); *A61G 5/1091* (2016.11); *A61G 7/05738* (2013.01); *B68G 1/00* (2013.01); *B68G 7/05* (2013.01)

(58) Field of Classification Search
CPC combination set(s) only.
See application file for complete search history.

(56) References Cited

U.S. PATENT DOCUMENTS 3,608,961 A * 9/1971 Von Heck ..... A47C 4/54 297/284.1
3,616,171 A * 10/1971 Hoskinson, Sr. .... A47C 27/086 428/300.7

(Continued)

*Primary Examiner* — Peter M. Cuomo
*Assistant Examiner* — Ifeolu A Adeboyejo
(74) *Attorney, Agent, or Firm* — Brouillette Legal Inc.; Robert Brouillette

(57) ABSTRACT

A method for fabricating a custom anatomical cushion and a device to capture pressure controlled shape is provided. The device comprises, generally, a flexible membrane enclosing floating beads adapted to be completely immersed and freely moving inside a fluid. The device further comprises a mesh adapted to stop the floating beads from going outside of the flexible membrane as a result of a pressure increase or decrease inside the flexible membrane. The device is being fluidly connected to a pressure control system adapted to increase and/or decrease the internal pressure of the flexible membrane and comprises a vibration/leveling system adapted to adjust the fluid level inside the flexible membrane.

20 Claims, 11 Drawing Sheets

(56) References Cited

U.S. PATENT DOCUMENTS

| | | | | | |
|---|---|---|---|---|---|
| 3,787,908 | A * | 1/1974 | Beck | A47C 27/085 | 5/676 |
| 4,011,611 | A | 3/1977 | Lederman | | |
| 4,045,830 | A * | 9/1977 | Loeb | A61G 1/00 | 5/81.1 T |
| 4,347,213 | A | 8/1982 | Rogers, Jr. | | |
| 4,615,856 | A * | 10/1986 | Silverman | A61F 5/01 | 264/102 |
| 4,852,945 | A * | 8/1989 | Rowles | A47C 7/46 | 297/452.28 |
| 5,176,424 | A * | 1/1993 | Tobita | A47C 27/082 | 297/284.1 |
| 6,192,537 | B1 | 2/2001 | Miki | | |
| 6,308,353 | B1 * | 10/2001 | Van Steenburg | A61F 5/05833 | 128/845 |
| 6,611,980 | B2 * | 9/2003 | Wempe | A47C 27/086 | 5/654 |
| 7,172,714 | B2 * | 2/2007 | Jacobson | B29C 33/308 | 264/108 |
| 8,167,672 | B2 | 5/2012 | Starmer | | |
| 2005/0116380 | A1 * | 6/2005 | Tadin | A43B 7/28 | 264/223 |
| 2008/0263772 | A1 * | 10/2008 | Chiu | A47C 4/54 | 5/654 |
| 2011/0272979 | A1 * | 11/2011 | Franz | A47C 3/12 | 297/217.1 |
| 2015/0128341 | A1 * | 5/2015 | Kuiper | A61G 7/001 | 5/83.1 |
| 2016/0213337 | A1 * | 7/2016 | Coppens | A61N 5/10 | |

* cited by examiner

METHOD FOR FABRICATING ANATOMICAL CUSHION AND DEVICE TO CAPTURE PRESSURE CONTROLLED SHAPE

CROSS-REFERENCE TO RELATED APPLICATIONS

The present patent application claims the benefits of priority of the U.S. Provisional Patent Application No. 62/332,519, entitled "Method for fabricating anatomical cushion and device to capture pressure controlled shape", and filed at the United States Patent And Trademark Office on May 6, 2016, the content of which is incorporated herein by reference.

FIELD OF THE INVENTION

The present invention generally relates to a method and device for fabricating anatomical cushions. More particularly, the present invention is adapted to fabricate or manufacture an anatomical cushion using a pressure control technique of a floating beads cushion.

BACKGROUND OF THE INVENTION

Nowadays, several different human measurement and shape capture technologies are used for fabricating anatomical cushions. These capture technologies include: X-rays, Stereo Photogrammetry, Mechanical Shape Sensing, Electromagnetic shape sensing and Laser scanning. However, generally, these technologies require fastidious procedures and a frequent presence of the patient.

Conventionally, floating beads cushions, such as the floating beads cushion disclosed in U.S. Pat. Nos. 4,347,213 and 8,167,672, are adapted to conform to the shape of an anatomical portion of a user resting on these cushions. However, the functional properties of these cushions do not allow preserving the shape of the anatomical portion of the user as soon as the user vacates the cushion.

SUMMARY OF THE INVENTION

The aforesaid and other objectives of the present invention are realized by generally providing a method for fabricating anatomical cushion and a device to capture a pressure controlled imprint.

In one aspect of the invention, an anatomical cushion is provided. The anatomical cushion comprises a flexible membrane forming a sealed enclosure which is adapted to receive a fluid and floating beads adapted to be immersed and moveable within the fluid. The anatomical cushion further comprises a pressure control system fluidly connected to the enclosure. The pressure control system is adapted to increase pressure within the enclosure by allowing fluid to flow in the enclosure and decrease pressure within the enclosure by allowing fluid to flow out of the enclosure. The anatomical cushion further comprises a mesh within the enclosure, the mesh forms a passage between the pressure control system and the enclosure and the mesh is being pervious to the liquid and impervious to the floating beads.

The anatomical cushion may further comprise a base portion. The flexible membrane may form a sealed enclosure with the base portion.

In another aspect of the invention, the floating beads have a density lower than the density of the fluid and the fluid has a viscosity between 0.5 cP and 100 cP.

In yet another aspect of the invention, the mesh is being rigid to resist to a decrease of the pressure within the enclosure without distorsion. The mesh is further being flat and the flexible membrane is being adapted to maintain the floating beads in a 3D shape on the mesh when the pressure within the enclosure is decreased.

In a further aspect of the invention, the pressure control system comprises a fluid tank being adapted to receive the fluid, a selector valve in fluid communication with the fluid tank, a pressure and vacuum pump in fluid communication with the selector valve;

and a conduit in fluid communication with the selector valve. The selector valve comprises two operation modes. A first operation mode directing flow of the fluid from the fluid tank to the anatomical cushion and a second operation mode directing flow of the fluid from the anatomical cushion to the fluid tank. A second operation mode triggering a pressure decrease of the enclosure, the pressure decrease creating friction between the floating beads. The floating beads being made of polystyrene and the fluid being water.

In yet another aspect of the invention, the flexible membrane may adopt a shape similar to the shape of an anatomical portion of a user on the anatomical cushion. The pressure of the anatomical portion of the user forming a negative print on the flexible membrane of 3D shape of the anatomical portion. The flexible membrane may be made of a polymer.

In yet another aspect of the invention, the anatomical cushion further comprises a vibration system, the vibration system generating vibrations in the enclosure and the anatomical cushion is being adapted to be mounted on a positioning device.

The present invention also provides a method for scanning an anatomical portion of a user. The method comprises the step of increasing pressure inside an anatomical cushion by adding a fluid, the step of decreasing the pressure inside the anatomical cushion while the anatomical portion of the user is on the anatomical cushion until floating beads are held together and the step of scanning the anatomical cushion to extract a cloud of points designing a 3D shape of the anatomical portion of the patient.

The method may further comprise the step of adjusting a patient's position on the positioning device and the step of activating a vibration system generating vibrations in the enclosure while decreasing the pressure. The method may further comprise using a computer program to adjust the cloud of points designing the 3D shape of the anatomical portion of the patient using a computer program.

The present invention also provides a system for scanning an anatomical portion of a user. The system comprises a positioning device which comprises a base and a positioning portion being configured to receive an anatomical cushion. The positioning portion being supported by the base. The positioning device further comprises at least one structural support serving as a scan reference surface. The structural support serving as a scan reference surface and being preferably an armrest. The system further comprises a flexible membrane forming a sealed enclosure which is adapted to receive a fluid and floating beads adapted to be immersed and moveable within the fluid. The system further comprises a pressure control system fluidly connected to the enclosure. The pressure control system is adapted to increase pressure within the enclosure by allowing fluid to flow in the enclosure and decrease pressure within the enclosure by allowing fluid to flow out of the enclosure. The system may further comprise a mesh within the enclosure. The mesh forms a passage between the pressure control system and the enclosure. The mesh is being pervious to the liquid and impervious to the floating beads.

In yet another aspect of the invention, the system is being adjustable and set according to the user anthropometry and activity.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel method for fabricating anatomical cushion and device to capture pressure controlled shape will be described hereinafter. Although the invention is described in terms of specific illustrative embodiments, it is to be understood that the embodiments described herein are by way of example only and that the scope of the invention is not intended to be limited thereby.

Figure 1:
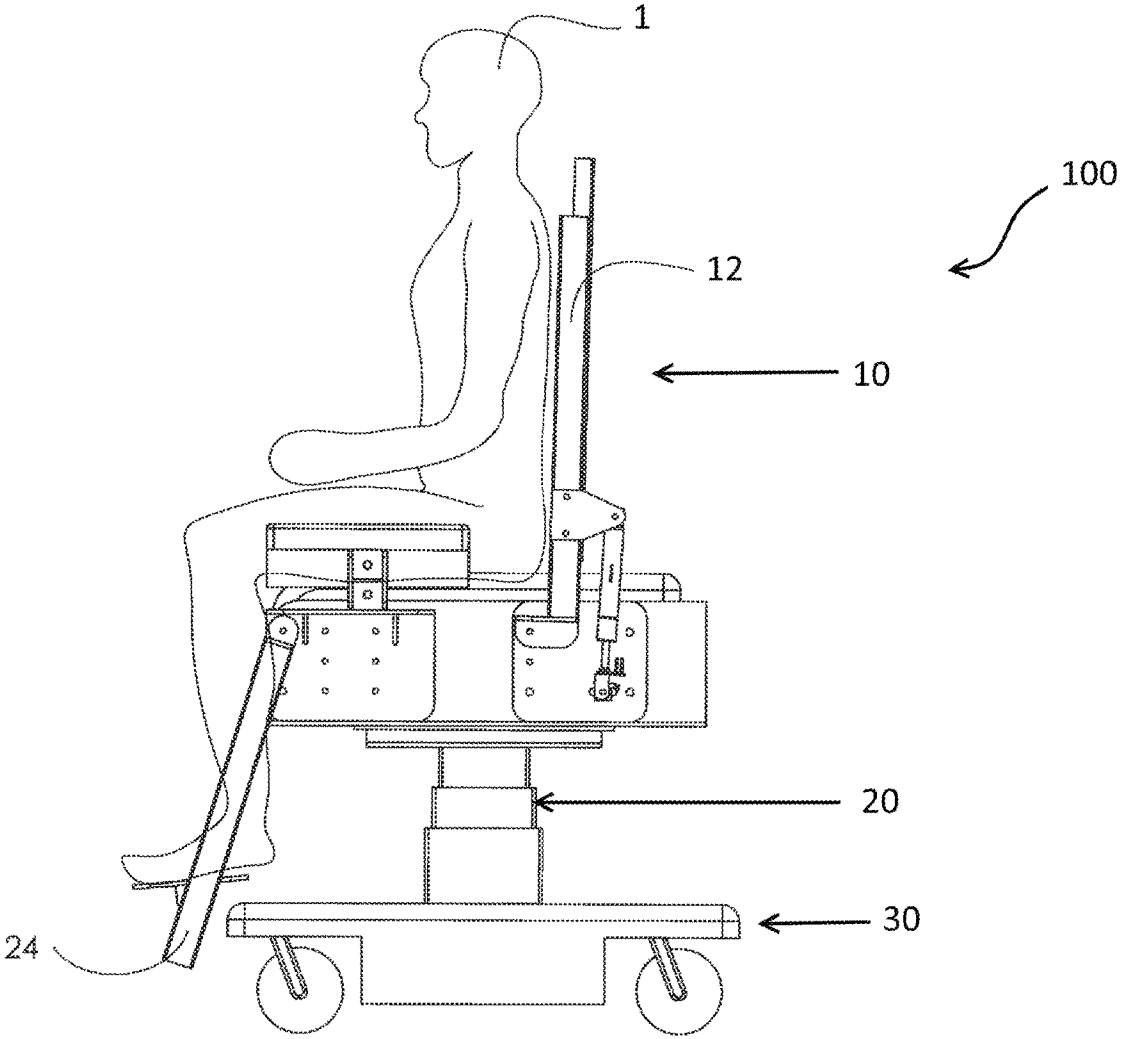
FIG. 1 is a side view of a positioning device being in use by a patient sitting on an anatomical cushion in accordance with the principles of the present invention.

Referring to FIG. 1 a preferred embodiment of a positioning device 100 adapted to be used during the process of creating a custom cushion is illustrated. The positioning device 100 generally aims at simulating the context/position for which an anatomical cushion is needed. The positioning device 100 comprises a positioning portion 10 suited to receive a user 1 and being supported by a mean or mechanism for adjustable height 20, such as a height adjustable column. The mechanism for adjusting height 20 is typically supported by a base 30, such as a wheeled support base.

Figure 2:
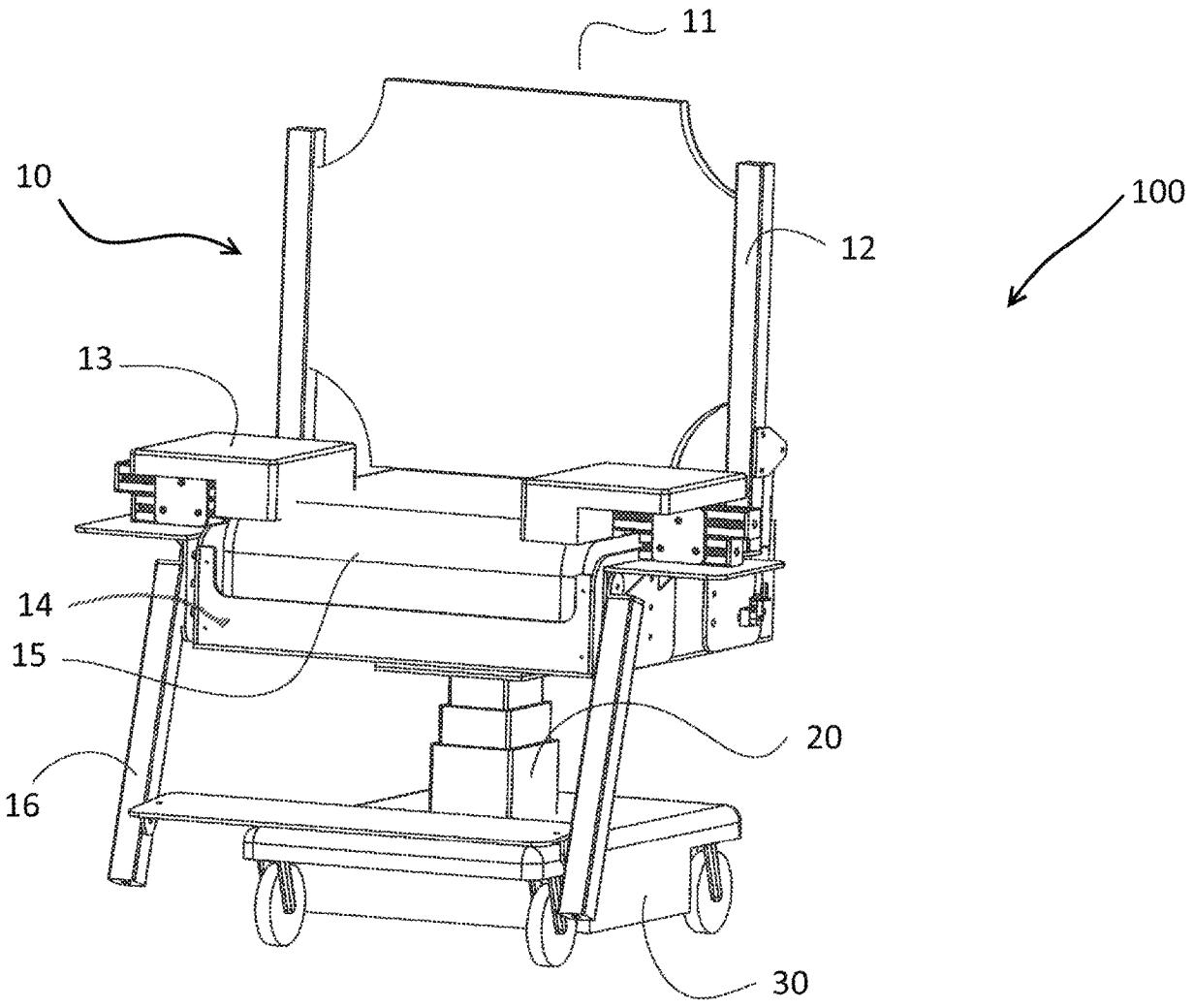
FIG. 2 is an isometric view of the positioning device comprising the anatomical cushion in accordance with the principles of the present invention.

Referring now to FIG. 2, the positioning portion 10 comprises a seat 11. In a preferred embodiment, the seat 11 comprises an anatomical cushion 15, an adjustable backrest 12, adjustable armrests 13 and a supporting structure 14 being configured to receive an anatomical cushion 15, also referred to as a floating beads cushion. Understandably, in other embodiments, the seat 11 may only comprise a structure adapted to receive the anatomical cushion 15.

The supporting structure 14 is shaped and adapted to receive the floating beads cushion 15. The supporting structure 14 is typically adapted to facilitate the installation of the floating beads cushion 15 on the positioning device 100. The positioning portion 10 may further comprise a mean to connect a leg rest 16 adapted to receive one or more legs of a user or patient sitting on the anatomical cushion 15. One skilled in the art shall understand that any other support member may be added for supporting other anatomical portion of the user without departing from the principles of the present invention.

Understandably, in a preferred embodiment, the backrest 12, the leg rest 16 and the armrests 13 may be adjustable and set according to the user 1 anthropometry and activity.

Preferably, the armrests 13 are configured in a way to serve as scanning reference surfaces during the process of creating a custom cushion.

Figure 3:
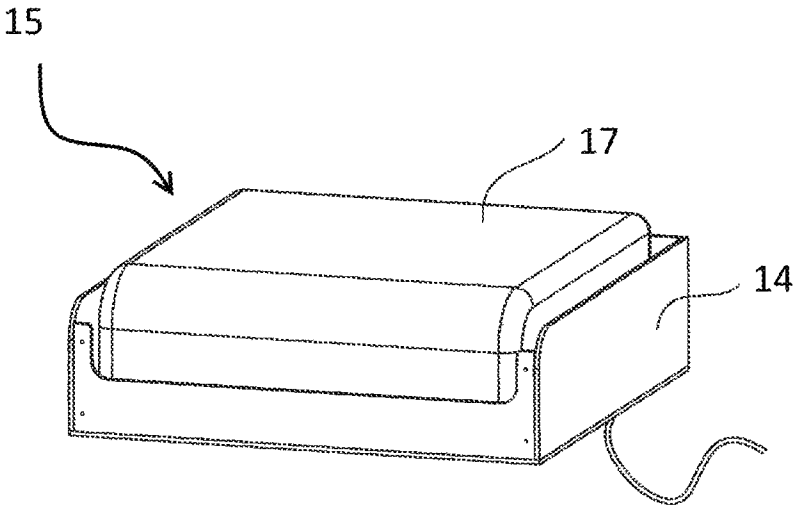
FIG. 3 is an isometric view of the anatomical cushion mounted to a supporting structure in accordance with the principles of the present invention.
Figure 4:
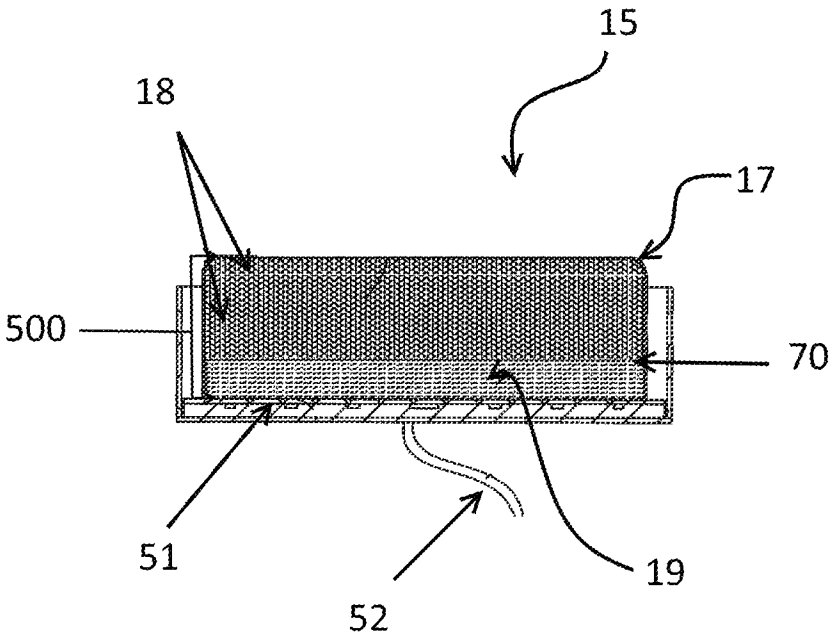
FIG. 4 is a front cross sectional view of the anatomical cushion mounted to the supporting structure in accordance with the principles of the present invention.

Referring now to FIGS. 3 and 4, a preferred embodiment of the anatomical cushion 15 being mounted to the supporting structure 14 is illustrated. The floating beads cushion 15 comprises a flexible membrane 17 forming an enclosure 500 for floating beads 18 and a fluid 19. As such, the floating beads 18 are immersed in the fluid 19 within the enclosure formed by the flexible membrane 17. As the beads 18 are immersed, the beads 18 may freely moved within the fluid 19. In a preferred embodiment, the beads 18 are fully immersed in the fluid 19.

In a preferred embodiment, the cushion 15 comprises a single type of fluid 19. The cushion is filled with fluid up to a predetermined fluid level 70. Generally, the floating beads 18 and the fluid 19 are chosen such as the density of the beads 18 is lower than the density of the fluid 19 to provide a desired or predetermined floatation level of the beads 18 inside the fluid 19.

Preferably, the viscosity of the fluid 19 is maintained as low as possible, typically lower than 100 cP and preferably in the range of 1 cP. The viscosity of the fluid 19 being maintained as low as possible aims at ensuring the beads 17 are quickly moving within the enclosure. Thus, in a preferred embodiment, the floating beads 18 are made of polystyrene and the fluid 19 is water.

In other embodiments, the flexible membrane may be sealed to a base portion in order to form together the enclosure 500 for the floating beads 18 and the fluid 19.

In other embodiments, the beads 18 may be made any material being floatable within the fluid 19 used, such as but not limited to expanded polypropylene beads.

Preferably, the external flexible membrane 17 is being made of a polymer, such as but not limited to latex, polyurethane or silicone.

Still referring to FIGS. 3 and 4, the floating beads cushion 15 further comprises a mesh 51, a conduit 52 connected to the enclosure. The mesh 51 comprises apertures sized to allow fluid 19 to pass through but to retain the beads 18 within the enclosure. In a preferred embodiment, the mesh 51 closes the bottom portion of the cushion 15. The conduit 52 provides a mean to inject fluid 19 within the enclosure or to drain the fluid 19 from the enclosure. The mesh 51 is generally adapted to stop or at least limit the beads 18 from flowing out with the fluid 19 through the conduit 52 to/from a pressure control system 50.

In a preferred embodiment, the mesh 51 is rigid and flat, aiming at resisting to the increase and/or decrease of pressure inside the enclosure. The mesh 51 maintains the 3D shape formed by the floating beads 18 as the beads are being firmly held together. The beads 18 are held together as a result of the decrease of the pressure inside the anatomical cushion 15 and particularly inside the enclosure.

Figure 5:
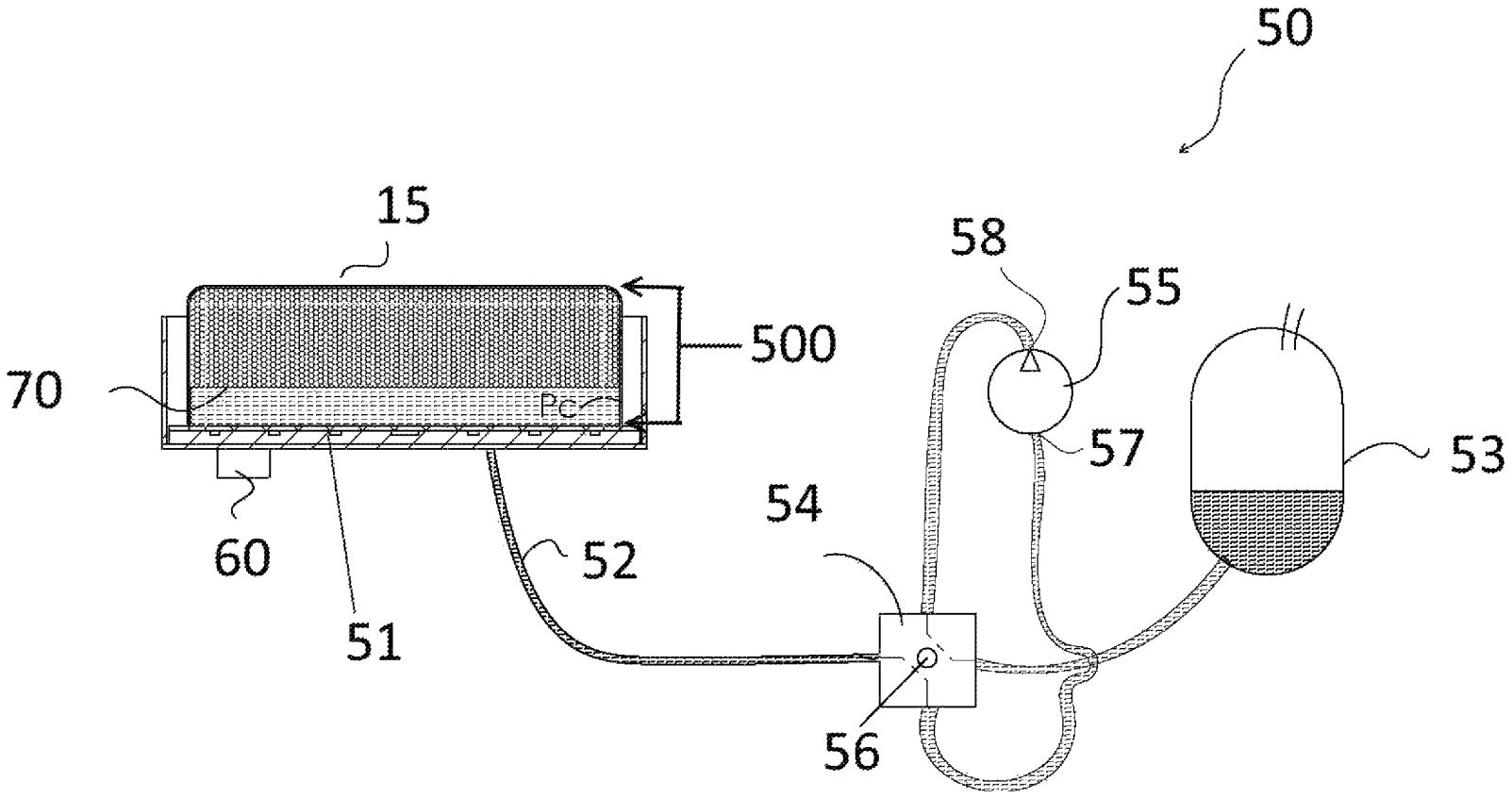
FIG. 5 is an illustrative view of the anatomical cushion connected to a pressure control system in accordance with the principles of the present invention.

Referring now to FIG. 5, a preferred embodiment of a pressure control system 50 in use with the cushion 15 is illustrated. The pressure control system 50 comprises a fluid tank 53, a selector valve 54 and a pressure/vacuum pump 55. The fluid tank is fluidly connected to a selector valve 54. The selector valve 54 is in fluid communication or fluidly connected to the pressure/vacuum pump 55 and to the conduit 52. The pressure pump 55 typically comprises a vacuum inlet 57 and a pressure outlet 58.

The selector valve 54 is preferably a two-position four-ways valve. The selector valve 54 may further comprise a handle 56 adapted to select a mode of the selector valve 54, thus to communicate the fluid through the desired ways. Understandably, when selecting a first of the two positions, the pressure outlet 58 of the pump 55 is in fluid communication to the cushion 15, thus allowing fluid 19 to flow from the fluid tank 53 to the cushion 15 to increase the beads/fluid level 70 within the enclosure.

When selecting a second of the two positions, the vacuum inlet 57 of the pump 55 is in fluid communication with the cushion 15, thus allowing a flow of fluid 19 from the cushion 15 to the fluid tank 53. Such second position drains the fluid 19 from the enclosure to lower the beads/fluid level 70 until the pressure inside the cushion 15 reaches the characteristic or predetermined maximum vacuum pressure of the pump 55.

In a preferred embodiment, the pressure control system 50 is configured to ensure a minimal level of the fluid 19 in the fluid tank 53.

Figure 6:
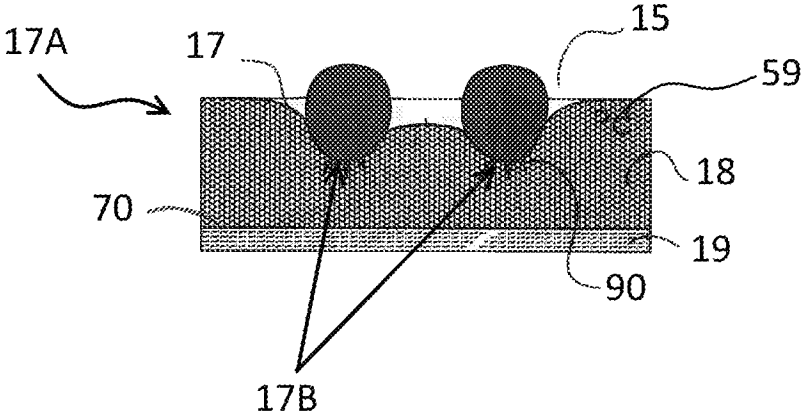
FIG. 6 is a front cross sectional view of the anatomical cushion supporting an anatomical portion of a user in accordance with the principles of the present invention.
Figure 7:
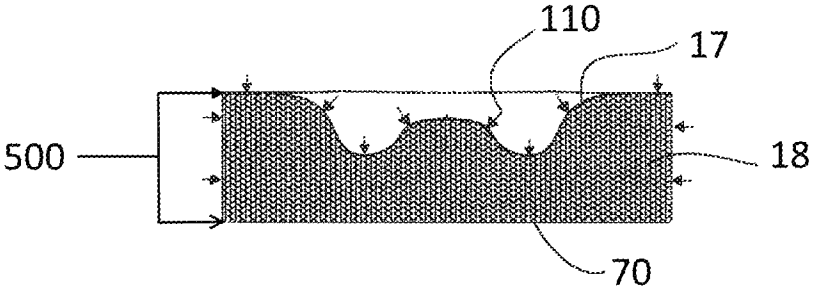
FIG. 7 is a front cross sectional view of the anatomical cushion showing an external pressure repartition on the anatomical cushion's membrane in accordance with the principles of the present invention.
Figure 8:
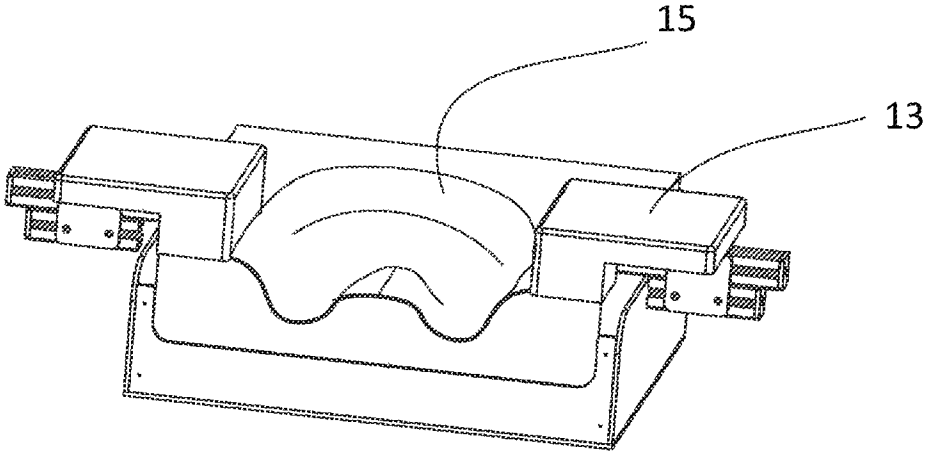
FIG. 8 is an isometric view of an anatomical cushion comprising scanning references in accordance with the principles of the present invention.

Referring now to FIGS. 6 to 8, some representative steps of creating a custom cushion are shown. As illustrated in FIG. 6, when an anatomical portion of a user 1 such as a buttock is disposed on the top of the floating beads cushion 15, the flexible membrane 17 adopts a shape similar, and if possible identical, to the shape of the anatomical portion of the user under a distributed pressure. The floating beads 18 enclosed inside the membrane 17 follows the upper portion 17A of the flexible membrane 17.

Understandably, the disposing of the anatomical portion of the user on the top of the cushion 15 creates an hydrostatic pressure 59 inside the floating bead cushion 15. Such hydrostatic pressure 59 generally results in creating a distributed reactional force 90 over the portion 17B of the flexible membrane 17 being in contact with the anatomical portion. Such a portion 17B of the flexible membrane is then in a lowered position compared to the remaining of the upper portion 17A. As shown by FIG. 7, such a reactional force 90 is distributed on the portion 17B of the flexible membrane 17. The portion of the flexible membrane in contact with the anatomical portion allows the printing of the 3D shape of the anatomical portion applying pressure on the cushion 15.

Referring further to FIGS. 5 and 7, when the fluid 19 is drained from the floating beads cushion 15 by activating the vacuum input 57, the internal pressure 59 of the flexible membrane 17 decreases and the beads/fluid level 70 decreases inside the floating beads cushion 15 until the beads 18 firmly hold together on the mesh 51 under the exterior pressure 110 applied on the flexible membrane 17. The friction between the beads 18, being enclosed between the mesh and the flexible membrane, keeps the 3D shape of the anatomical portion printed over the flexible membrane of the anatomical cushion (See FIG. 8). The 3D shape of the anatomical portion 15 is then used to manufacture and/or fabricate a custom cushion, a prosthetic or any device that need to be pressure fitted with the previously acquired anatomical portion of an individual (See FIG. 9).

Figure 10:
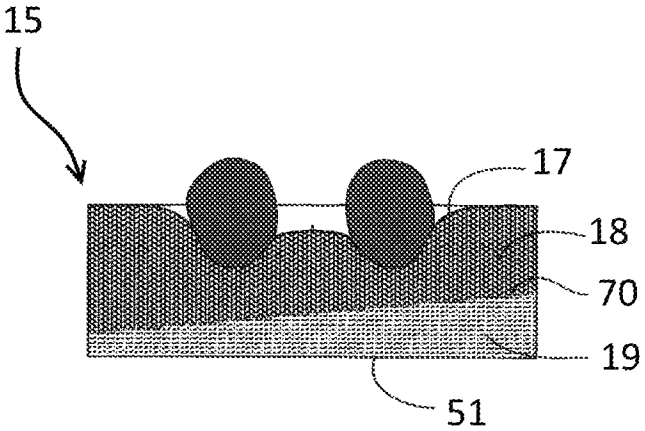
FIG. 10 is a front cross sectional view of the anatomical cushion supporting the anatomical portion of a user and having an inclined repartition level of beads/fluid in accordance with the principles of the present invention

Referring now to FIG. 10, the floating beads cushion 15 is shown with uneven level of beads 18 and/or fluid 19. In such an embodiment, the beads/fluid level 70 become not parallel or uneven with regard to the mesh 51 once an anatomical portion is disposed on the top of the cushion 15. This uneven configuration creates a distortion in the 3D shape of the anatomical portion over the flexible membrane 17 of the floating beads cushion 15 when the beads/fluid level 70 reaches the mesh 51. The occurrence of this problem is caused by friction between beads 18 and the viscosity of the fluid 19.

In one embodiment, a vibration/leveling system 60 (FIG. 5) may be integrated to the floating beads cushion 15. The vibration/leveling system 60 may be embodied as a mechanical or an electro-mechanical device generating vibrations on the supporting structure 14 holding the cushion 15 or directly in the fluid 19.

Figure 11:
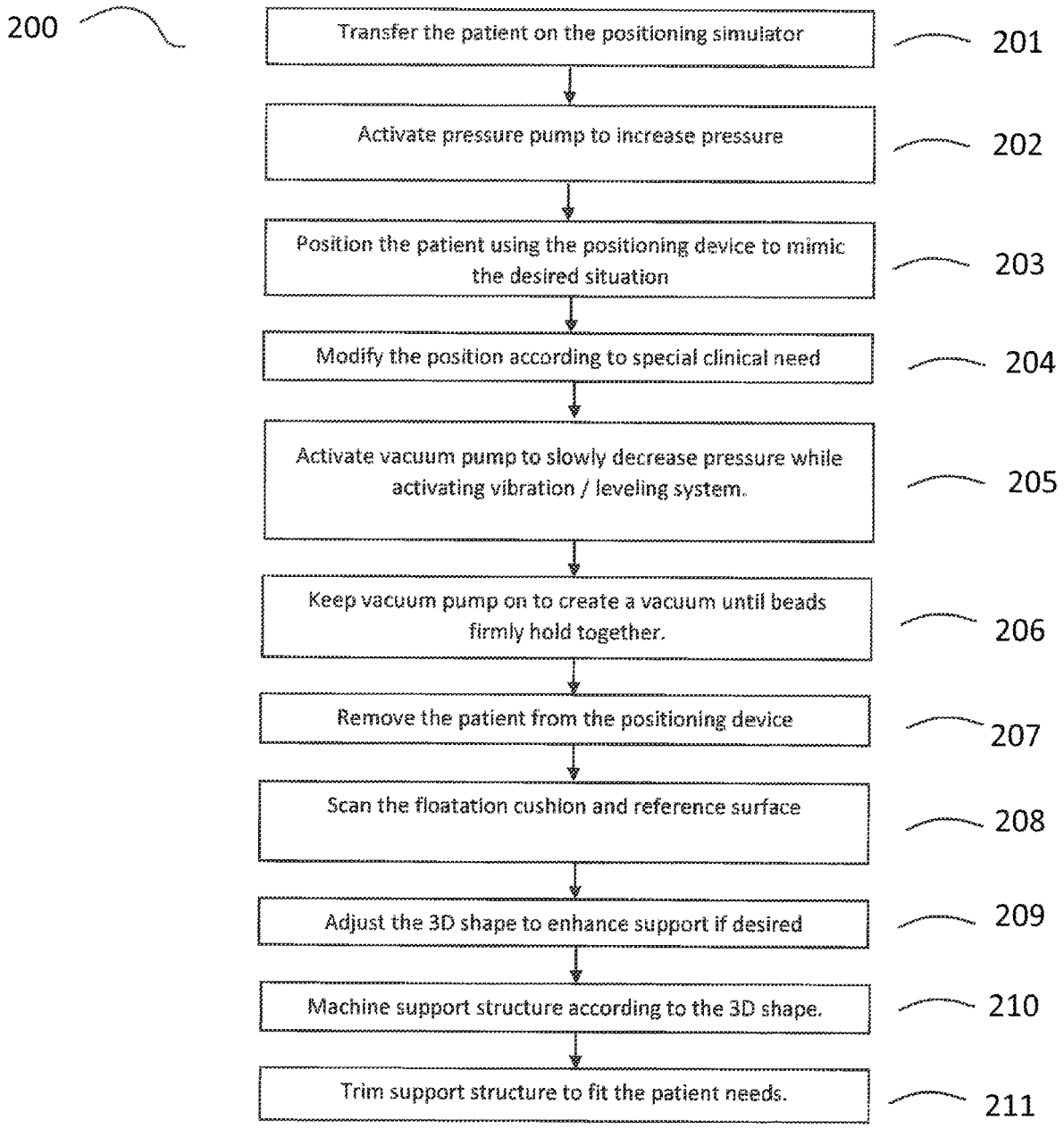
FIG. 11 is a representative flowchart of exemplary steps illustrating a method to create a custom cushion using the anatomical cushion in accordance with the principles of the present invention.

Now referring to FIG. 11, a method 200 to create a custom cushion 15 for a user is shown. The method may comprise positioning the patient 1 on the positioning simulator/device 201. By positioning the user, one must ensure that the proper anatomical portion of the user rests on the floating beads cushion 15. The method may further comprise, once the patient 1 is positioned, in increasing the pressure within the cushion 202. In a preferred embodiment, the pressure pump is activated to increase the level of fluid in the cushion 15 from the fluid tank 53. As such, the fluid flows toward the floating beads cushion 15 until the beads/fluid level 70 is high enough, making the patient 1 and all beads 18 floating. The method may further comprise, when the user/body portion is floating, further positioning the patient 1 using the positioning device 22 to mimic one ore more desired situations 203. The method may further comprise modifying the position of the patient according to one or more special clinical needs 204.

The method 200 further comprises, when the patient 1 is properly positioned, to slowly decrease the pressure to lower the fluid level in the enclosure of the cushion until the beads/fluid level 70 reach the mesh 205. In a preferred embodiment, the vacuum pump input 57 is activated to lower the fluid tank 53. The method 200 may further comprise activating the vibration/leveling system 60 while lowering the volume of fluid in the cushion. The vibration/leveling system 60 aims at keeping the beads/fluid level 70 parallel to the mesh 51 to avoid creating distortion in the 3D shape of the anatomical portion over the flexible membrane 17 of the floating beads cushion 15.

Still referring to FIG. 11, the method 200 further comprise maintaining the vacuum within the cushion 15, generally aiming at creating a negative impression of the 3D shape of the anatomical portion. In a preferred embodiment, the vacuum port of the pump 55 is maintained in operation and fluidly connected to the floating beads cushion 15 to create vacuum until beads 18 firmly hold together with exterior pressure 110 (FIG. 7) applied on the polymer membrane 17.

Thereafter, the method 200 may further comprise removing the patient 1 from the positioning device 100 (step 207) and scanning the rigid floating beads cushion 15 and reference surface. The scanning 207 may be executed using the armrests 13 as the reference surfaces (step 208) as shown in FIG. 8 to capture the 3D shape of the anatomical portion of the patient 1.

Optionally, the method 200 may comprise adjusting the cloud point of the captured 3D shape using a computer program, such as a surface modeling software to capture 3D coordinates of the cushion and model such coordinate in a 3D model. During such step 209, support, additional or desired characteristics may be added to the custom cushion.

Figure 9:
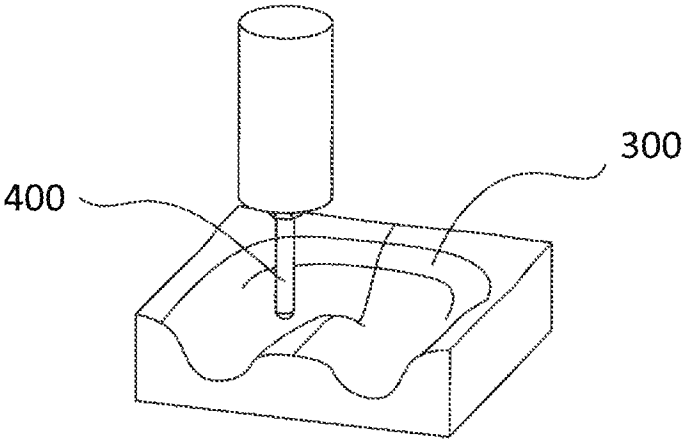
FIG. 9 is an isometric view of a support structure being machined into a custom cushion in accordance with the principles of the present invention.

The method 200 may further comprise using the 3D model to machine a support structure 300 into a custom cushion using proper machining tools 400 (shown in FIG. 9). The support structure 300 may be made of polyurethane foam, polystyrene foam or any material that will meet the support needs. Finally the custom cushion can be trimmed to fit the patient needs (step 211).

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

What is claimed is:

1. A pressure distributed anatomical shape capturing device, the shape capturing device comprising:

a flexible membrane forming a sealed enclosure, the enclosure being adapted to receive a fluid, the enclosure comprising:

an upper portion comprising floating beads adapted to be immersed and moveable within the fluid;

a lower buffering portion of the sealed enclosure comprising fluid;

a pressure control system fluidly connected to the enclosure, the pressure control system adapted to:

increase pressure within the enclosure by allowing fluid to flow in the enclosure; and decrease pressure within the enclosure by allowing fluid to flow out of the enclosure;

a mesh within the enclosure, the mesh forming a passage between the pressure control system and the enclosure, the mesh being pervious to the liquid and impervious to the floating beads.

2. The shape capturing device of claim 1, the shape capturing device further comprising a base portion and the flexible membrane forming a sealed enclosure with the base portion.

3. The shape capturing device of claim 1, the floating beads being compressible.

4. The shape capturing device of claim 1, the fluid having a viscosity between 0.5 cP and 100 cP.

5. The shape capturing device of claim 1, the mesh being rigid to resist to a decrease of the pressure within the enclosure.

6. The shape capturing device of claim 1, the mesh being flat, the flexible membrane being adapted to maintain the floating beads in a 3D shape on the mesh when the pressure within the enclosure is decreased.

7. The shape capturing device of claim 1, wherein the pressure control system further comprises:

a fluid tank being adapted to receive the fluid;

a selector valve in fluid communication with the fluid tank;

a pressure and vacuum pump in fluid communication with the selector valve; and a conduit in fluid communication with the selector valve;

wherein the selector valve comprises two operation modes:

a first operation mode directing flow of the fluid from the fluid tank to the sealed enclosure; and a second operation mode directing flow of the fluid from the sealed enclosure to the fluid tank.

8. The shape capturing device of claim 1, the pressure of the anatomical portion of the user forming a negative print on the flexible membrane of 3D shape of the anatomical portion.

9. The shape capturing device of claim 1, the shape capturing device being adapted to be mounted on a positioning device.

10. The shape capturing device of claim 1, the floating beads being made of polystyrene and the fluid being water.

11. A method for scanning an anatomical portion of a user, the method comprising:

adding a fluid to a shape capturing device to form an upper portion comprising floating beads and the fluid and a lower buffering portion comprising the fluid;

decreasing the pressure inside the shape capturing device while the anatomical portion of the user is on the shape capturing device while the floating beads in the upper portion are moving with regard to the others;

further decreasing pressure inside the shape capturing device until floating beads are held together by friction;

scanning the shape capturing device to extract a cloud of points designing a 3D shape of the anatomical portion of the patient.

12. The method of claim 11, the method further comprising adjusting a patient's position on the positioning device while the lower buffering portion comprises fluid.

13. The method of claim 11, the method further comprises using a computer program to adjust the cloud of points designing the 3D shape of the anatomical portion of the patient using a computer program.

14. A system for scanning an anatomical portion of a user, the system comprising:

a positioning device comprising:

a base;

a positioning portion being configured to receive a shape capturing device; the positioning portion being supported by the base; and at least one structural support serving as a scan reference surface;

a flexible membrane forming a sealed enclosure, the enclosure being adapted to receive a fluid, the sealed enclosure comprising:

an upper portion comprising floating beads adapted to be immersed and moveable within the fluid;

a lower buffering portion of the sealed enclosure comprising fluid;

a pressure control system fluidly connected to the enclosure, the pressure control system adapted to:

increase pressure within the enclosure by allowing fluid to flow in the enclosure; and decrease pressure within the enclosure by allowing fluid to flow out of the enclosure;

a mesh within the enclosure, the mesh forming a passage between the pressure control system and the enclosure, the mesh being pervious to the liquid and impervious to the floating beads.

15. The system of claim 14, wherein the at least structural support serving as a scan reference surface being an armrest.

16. The system of claim 14, the system being adjustable and set according to the user anthropometry and activity.

17. The shape capturing device of claim 1, the floating beads remaining movable in the upper portion while the lower buffering portion comprises fluid.

18. The shape capturing device of claim 1, the mesh extending along the width of the bottom of the lower buffering portion of the sealed enclosure.

19. The shape capturing device of claim 1, the shape capturing device further comprising a rigid plate under a surface covered by the mesh.

20. The shape capturing device of claim 3, the floating beads being resilient.

* * * * *